United States Patent [19]

Hoy

[11] 4,214,577

[45] Jul. 29, 1980

[54] ORTHOSIS FOR EXERCISING JOINT

[76] Inventor: Mansell I. Hoy, R.R. #1, Oxford Mill, Ontario, Canada

[21] Appl. No.: 881,664

[22] Filed: Feb. 27, 1978

[51] Int. Cl.[2] ..... A61H 1/02

[52] U.S. Cl. ..... 128/25 R

[58] Field of Search ..... 128/25 R, 25 B, 88, 128/24 R, 77, 80 R, 80 G

[56] References Cited

U.S. PATENT DOCUMENTS

| | | | |
|---|---|---|---|
| 649,237 | 5/1900 | Dyson | 128/88 |
| 1,847,823 | 3/1932 | Dresser | 128/88 |
| 2,767,708 | 10/1956 | Keropian | 128/77 |
| 3,976,057 | 8/1976 | Barclay | 128/25 R |

FOREIGN PATENT DOCUMENTS

| | | | |
|---|---|---|---|
| 1384049 | 11/1964 | France | 128/25 R |

*Primary Examiner*—Lawrence W. Trapp

[57] ABSTRACT

An orthosis for passive and active movement of a joint of a body limb, permitting application of adjustable flexion or extension bias to that limb without the application of direct force on the joint. A spaced pair of proximal and distal shafts for medial and lateral positioning about the joint and proximal and distal parts of the limb are provided, these cooperating proximal and distal shafts being joined at a pivot. The pivots are juxtaposed the joint and permit pivoting the distal shafts in a direction corresponding to the direction of movement of the distal part of the limb. Cuff and strap means are secured between opposite proximal and opposite distal shafts to releasably secure the orthosis to proximal and distal parts of the limb. Securing means are associated with portions of the proximal and distal shafts at positions spaced from the pivots. Linear biasing means, such as elastic bands or springs, are releasably secured by these securing means to join proximal and distal shafts, the securing means being so positioned, with respect to the shafts, that the linear biasing means are capable of being secured thereto to exert either flexion or extension bias on the proximal shafts.

8 Claims, 5 Drawing Figures

ORTHOSIS FOR EXERCISING JOINT

BACKGROUND OF THE INVENTION

This invention relates generally to an orthosis for passive or active movement of a joint and more particularly concerns a therapeutic apparatus which will enable exercising of a body joint and the muscles of the surrounding limb without direct application of pressure on that joint. The invention is particularly effective for a joint such as an elbow joint.

An orthosis is an orthopedic instrument that applies motion to a part of a body. After injury or illness or following surgery or other medical techniques affecting a limb of the body, the joint may stiffen very rapidly as a result of its immobilization, and, in such a case, usually requires a great deal of therapy to enable that joint to regain its motion. The therapy involved may take two forms. It may be necessary to move the joint, under controlled conditions as prescribed by an attending physician, where the patient has not sufficient muscle development to flex and extend the parts of the limb about that joint. In such a case it is necessary to apply external force to flex and extend the body portion surrounding the joint, for example with the aid of a physical therapist who carefully moves the limb, flexing it and extending it about the joint to induce motion. Such externally induced motion is called "passive motion". The second form occurs when the patient has or has developed sufficient muscle strength in the body portion surrounding the joint to himself flex or extend the limb, although the muscle strength may be much reduced and motion may be extremely slow and painful. Such motion will be called "active motion". In situations where either passive or active motion is involved, the range of extension and flexion motion of the parts of the limb about the joint may, as a result of the patient's condition, be greatly reduced from normal. This range of motion, measured in degrees, for the parts of an arm about an elbow, may range from zero degrees to 130 degrees for a normal, healthy arm. After injury, surgery or illness, for example, this range may be greatly restricted, for example to 50 degrees to 85 degrees (extension to flexion).

The procedures requiring motion of a body joint traditionally often require care by a physiotherapist, and occupy substantial time, effort and attention with each patient. In addition, such treatment may be frequently painful to the patient and too irregular for maximum benefit.

Devices have been proposed previously which will assist a physiotherapist to exercise a disabled joint of a patient or which will assist the patient himself to administer the manipulative treatment himself. For example, U.S. Pat. No. 2,832,334 of Whitelaw, issued Apr. 29, 1958, describes a therapeutic device consisting of two bars joined at a pivot, the device to be strapped to the limb having the joint to be exercised so that the pivot of the device is positioned adjacent the joint to be manipulated. Associated with the pivot is a housing containing gear and pinion members which cooperate with a friction member to enable adjustment of the resistive forces acting against the pivoting of the bars or alternatively to adjust the amount of external force which is applied to the device to enable motion to be imparted to the bars and the joint. This device requires careful machining of the components to be fitted into this housing, as well as relatively detailed assemblage thereof, and consequently is a relatively expensive device. In addition, this device does not give adequate support of the limbs of the body to enable it to be used for a badly damaged joint where, for example, there may be lateral drift to the joint.

Keropian, U.S. Pat. No. 2,767,708, issued Oct. 23, 1956, describes and illustrates an orthopedic brace for a hand which is secured to the forearm. The device comprises a hand support made up of a pair of spaced, articulated bars disposed on the inner and outer side of the forearm and hand. The device however is not intended or designed for exercise or movement of limb joints, its purpose being mainly to urge the hand of the wearer towards an open or closed position.

Other references describing joint manipulating or exercising apparatus are U.S. Pat. No. 3,976,057 of Barclay, issued Aug. 24, 1976; U.S. Pat. No. 3,683,897 of Shield, et. al., issued Aug. 15, 1972; and U.S. Pat. No. 3,323,518 of Swanson, issued June 6, 1967;—all of which describe relatively complicated mechanical means to enable or cause pivoting of braces strapped to limbs about the joint region.

Also of background interest is U.S. Pat. No. 3,785,371 of Lewis, issued Jan. 15, 1974 which describes and illustrates an elbow sleeve for restricting an elbow against straightening beyond a preselected adjustably variable bent position.

Other types of braces of general background interest are illustrated in Canadian Pat. No. 519,118, issued Dec. 6, 1955 to Seelert and Canadian Pat. No. 595,450, issued Apr. 5, 1960 to Rehnberg.

It is an object of the present invention to provide an inexpensive, lightweight, portable therapeutic device which may be used to impart passive or active motion to the limbs surrounding a joint of a body such as the elbow joint or knee joint. It is a further object of the device to provide a simple device which may be operated by the patient himself or a physiotherapist, to impart both flexing and extending motion to such limbs or to so exercise them to increase muscle strength and to increase the range of motion of the limbs. It is a further object of the present invention to provide a device of the type described which will enable the operator to impart the desired motion to the joint by the application of controlled, predetermined forces. These and other objects of the invention will be understood from the following description of the invention.

SUMMARY OF THE INVENTION

In accordance with the present invention there is provided an orthosis for passive or active movement of a joint of a body limb. The orthosis comprises spaced pairs of proximal and distal shafts for medial and lateral positioning about the joint and proximal and distal parts of the limb. Cooperating proximal and distal shafts are joined at a pivot, the pivots to be juxtaposed the joint and permit pivoting of the distal shafts in a direction corresponding to the direction of movement of the distal part of the limb when the orthosis is secured to the limb. Limb holding means are secured between opposite proximal and opposite distal enable the orthosis to be releasably held to proximal and to distal parts of the limb. Securing means are associated with portions of the proximal and distal shafts. Linear biasing means, such as one or more springs or tension bands, are releasably secured by the securing means to join proximal and distal shafts. The linear biasing means are so secured by the securing means that they exert either flexion or extension torque on the proximal shafts. In a preferred embodiment, the securing means comprise a plurality of lever arms fixed to and extending away from the shafts. Additionally, lugs may be provided on the sides of the shafts, projecting outwardly away from the limb, to releasably secure the biasing means. Both the lever arms and the lugs are preferably adjustable at various positions on the shafts. The biasing means extend between selected lugs and/or levers to produce the desired flexion or extension torque.

Such an orthosis is clearly easy and economical to manufacture because of the simple components from which it is made. It has a few moving parts, another advantage over many of the previously mentioned prior art devices. Moreover, a patient or therapist may readily strap the device to the patient's arm and attach the appropriate biasing means to the appropriate securing means to have the device ready for use. The device is of such a nature that a patient may in his own home, readily secure it to a limb for passive or active movement thereby reducing the need for expensive therapy treatment under a therapist and, because of its convenience, encouraging the patient to use the device until full joint movement and/or muscle power in the body limb have been regained.

BRIEF DESCRIPTION OF THE DRAWINGS

Other objects and advantages of the invention will become apparent upon reading the following detailed description and upon referring to the drawings in which.

FIGS. *2a, b, c* and *d* are schematic views of an orthosis according to the present invention set up respectively for flexion (beginning and final positions) and extension (beginning and final positions).

While the invention will be described in connection with example embodiments thereof, it will be understood that it is not intended to limit the invention to such embodiments. On the contrary it is intended to cover all alternatives, modifications and equivalents as may be included within the spirit and scope of the invention as defined by the appended claims.

DETAILED DESCRIPTION OF THE INVENTION

Figure 1:
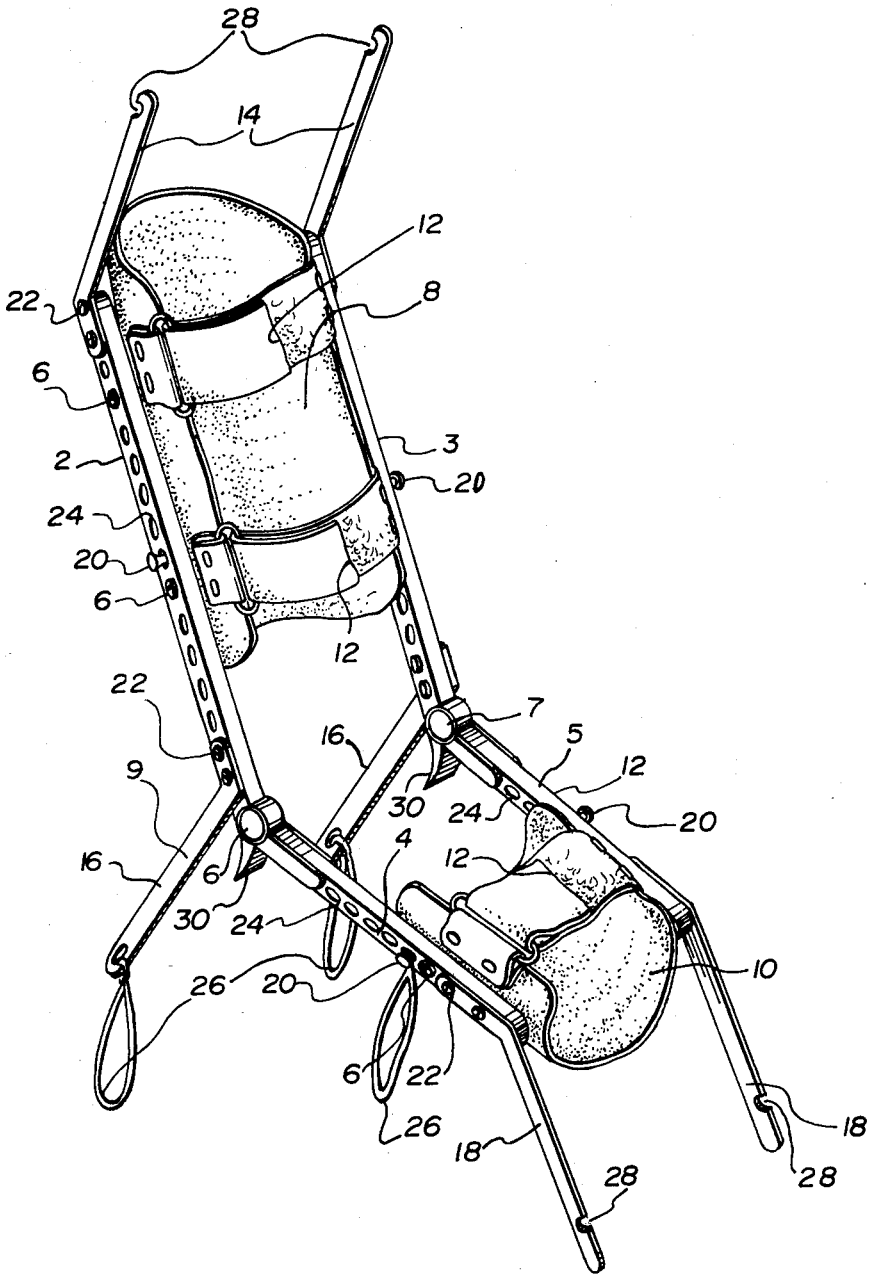
FIG. 1 is a perspective view of an example embodiment of an orthosis according to the present invention as applied to an arm.
Figure 2A:
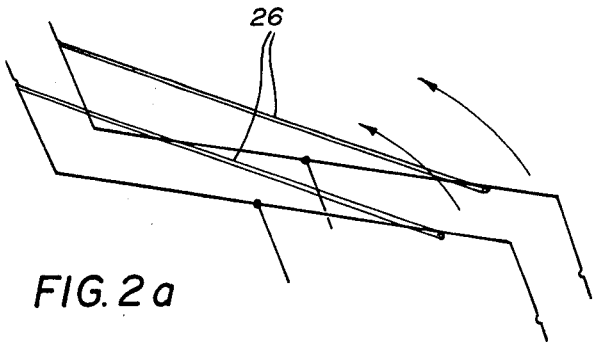
Figure 2B:
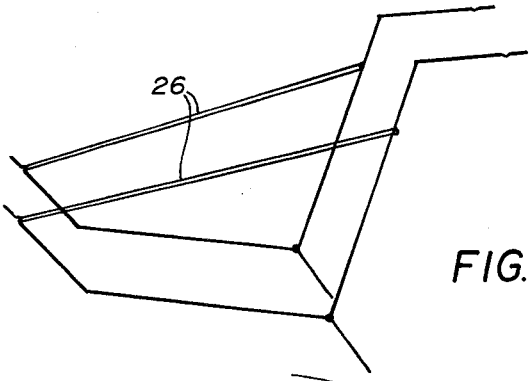
Figure 2D:
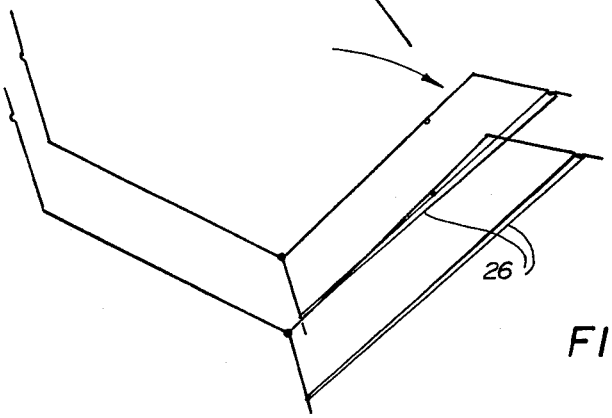
Figure 2C:
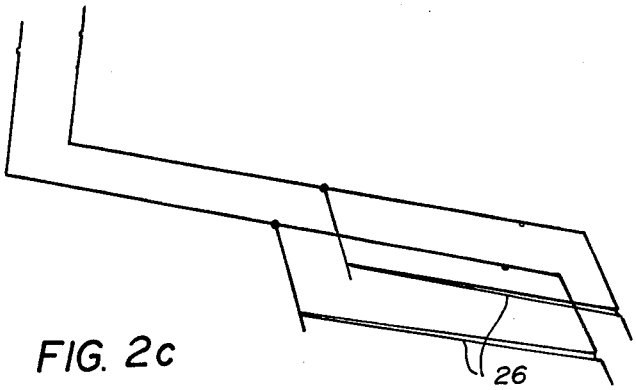

Turning to FIG. 1 there is shown an orthosis intended for an arm comprising spaced pairs of proximal shafts 2 and 3 and spaced pairs of distal shafts 4 and 5, cooperating shafts 2 and 4 being joined at pivot 6, and cooperating shafts 3 and 5 being joined at pivot 7. These pivots permit their associated distal shafts to pivot in a direction corresponding to the direction of movement of the distal part of the limb. The orthosis illustrated is intended for the patient's left arm, and consequently, for increased comfort, proximal and distal shafts are contoured to the normal profile of the adjacent part of that particular limb to which the orthosis is to be fitted. Between proximal shafts 2 and 3, is secured proximal cuff 8; a distal cuff 10 is similarly secured between distal shafts 4 and 5. Straps 12 act to releasably secure proximal and distal parts of the arm in corresponding cuffs, so that the orthosis is appropriately and releasably secured to the arm to be moved.

To the upper end of proximal shafts 2 and 3 are secured upstanding, upper proximal lever arms 14. At the other, lower end of the proximal shafts 2 and 3, are secured downwardly extending lower proximal lever arms 16. Distal shafts 4 and 5 are provided with a further pair of lever arms 18, similarly downwardly extending. The proximal and distal shafts are also provided with lugs 20. Lugs 20 and lever arms 14, 16 and 18 are all adjustably securable to different positions along the shafts in question by means of screws 22 through lever arms 14, 16 and 18, or threaded ends of lugs 20 engaging threaded holes 24 in the sides of distal shafts 2, 3, 4 and 5.

Liner biasing means, comprising elastic tension bands 26 are associated with appropriate lever arm or lugs, as illustrated in FIGS. 1 and 2, to achieve appropriate passive or active movement of the joint of the arm to which this orthosis is attached. Appropriate grooves 28 are located in lever arms 14 and 18 or receive appropriate ends of elastic tension bands 26. It will be understood that the elastic bands (or indeed any other appropriate linear biasing means) is to be releasably secured by the lever arms and/or lugs to join proximal and distal shafts so that appropriate flexion or extension torque about pivots 6 and 7 is exerted on the proximal shafts.

When tension bands 26 are attached to upper proximal lever arms 14 and lugs 20 on distal shafts 4 and 5 as illustrated in FIGS. *2a* and *2b*, flexion of the orthosis and the limb to which it is secured occurs; when bands 26 are secured to lever arms 16 and 18 as illustrated in FIGS. *2c* and *2d*, they exert extension torque on these shafts and the arm. It should be noted, in FIG. 1, that stops 30 prevent extension of distal shafts 4 and 5 beyond a certain point, that point being the position corresponding to the normal position of full extension of the distal part of an arm to which the orthosis if fitted. Bands 26 when the orthosis is in operation, remains approximately in the plane of relative movement of the proximal and distal shafts to which they are secured.

When it is intended to provide passive flexing of a person's arm, for example when the person has little or no muscular ability to flex the arm, the bands 26 would be set as illustrated in FIGS. *2a* and *2b*. When passive extension of the arm in the orthosis is desired, the bands would be set as in FIGS. *2c* and *2d*. on the other hand, when there is sufficient muscular ability in the arm of the patient to flex and extend the arm, and it is desired to provide active movement of the joint, resistance to the extension motion can be achieved by setting the bands as illustrated in FIGS. *2a* and *2b*, and resistance to the flexing movement of the arm can be achieved by setting the bands as illustrated in FIGS. *2c* and *2d*. Of course, the force exerted on the limb by the orthosis during flexion or extension movement may be appropriately adjusted either by altering the position of the lugs and/or lever arms to which the bands or springs are attached or by providing a number of different lugs and selecting appropriate combinations of lugs and/or lever arms to which the bands or springs are attached, or alternately by changing the number of bands extending between these hooks and levers or using bands of different elasticity.

The orthosis according to the present invention, besides permitting passive or active movement of the joint of a body limb without applying any direct pressure to that joint, provides stability to that limb against lateral or medial movement of the distal part of the limb. This may be important, for example, where a patient has a badly damaged elbow which tends to permit the distal part of the arm to move laterally or medially in the elbow socket.

In experiments which have been conducted using the orthosis of the present invention, improvement in mobility and range of motion of arms of patients has been achieved, even in situations where physiotherapy was not producing improved movement of the arm. Moreover, it is envisaged that in some instances, because of the precise torque control which is possible to achieve using the orthosis of the present invention and because of the danger that a physiotherapist might apply too much pressure to the limb or otherwise cause damage to the joint, a physician may prescribe such a device for manipulative movement of a limb joint rather than physiotherapy.

It will be understood that the orthosis according to the present invention is economical and simple to manufacture. The shafts may be made for example from aluminum, the cuffs may be made from polypropylene with any appropriate padding. The tension bands may be of any appropriate elastic material.

This orthosis enables a patient to be placed on early exercise programs which they can carry out in their own home, thereby minimizing the need for frequent physiotherapy treatments under close supervision. The orthosis may be custom fitted, with the shafts and cuffs being made of an appropriate size for the limb to be fitted. The device is extremely effective because, as is understood by physiotherapists, a tolerable amount of constant force on a joint will improve the range of motion of the limb much faster than strong forces for short periods of time on the limb. Moreover, the physician has better control over the forces to be applied to the limb of the patient using the orthosis of the present invention.

Thus it is apparent that there has been provided, in accordance with the present invention, an orthosis for passive or active movement of a joint of a body limb that fully satisfies the objects, aims and advantages set forth above. While the invention has been described in conjunction with specific embodiments thereof, it is evident that many alternatives, modifications and variations will be apparent to those skilled in the art in light of the foregoing description. It is intended to embrace all such alternatives, modifications and variations as fall within the spirit and broad scope of the appended claims.

I claim as my invention:

1. An orthosis for passive or active movement of a joint of a body limb comprising:

(a) spaced pairs of proximal and distal shafts for medial and lateral positioning about the proximal and distal parts of the limb at each side of the joint, cooperating proximal and distal shafts being joined at a pivot, the pivots to be juxtaposed the joint and permit pivoting of the distal shafts in a direction corresponding to the direction of movement of the distal part of the limb with lugs projecting outwardly away from the limb along the sides of the shaft;

(b) limb holding means secured between opposite proximal and opposite distal shafts for releasably securing the orthosis to proximal and to distal parts of the limb;

(c) a plurality of lever arms fixed to and extending away from portions of the proximal and distal shafts;

(d) linear biasing means to be releasably secured by and extending between selected lugs or lever arms to join proximal and distal shafts, and so secured by the lugs or lever arms that they exert either flexion or extension torque about the pivots on the proximal shafts without the necessity of repositioning the securing means, the shafts, lever arms and lugs being provided with means to permit the lever arms and lugs to be adjustably secured to the shafts at various positions along the lengths of the shafts, whereby the torque exerted by the biasing means may be adjusted.

2. An orthosis according to claim 1, wherein each proximal shaft is provided with an upstanding lever arm, one end of which is securable to different positions at the upper end of that shaft and a lower, downwardly extending lever arm, one end of which is securable to different positions at the lower end of the proximal shaft, and the distal shaft is provided with a further, downwardly extending lever arm, one end of which is securable to different positions at the free end of that shaft, means being provided near the free ends of these lever arms to releasably hold ends of the biasing means.

3. An orthosis according to claim 2, wherein the shafts are further provided with lugs, outwardly extending in a direction away from the limb, and adjustably securable at different positions along the shafts for receiving ends of the biasing means.

4. An orthosis according to claim 1, wherein cuff and strap means are secured between opposite proximal and opposite distal shafts for releasably securing therein proximal and distal parts of the limb.

5. An orthosis according to claim 1, wherein the biasing means is one or more flexible elastic tension bands.

6. An orthosis according to claim 1, wherein stops are provided to prevent extension pivoting of the distal shafts with respect to the proximal shafts beyond a position corresponding to the normal position of full extension of the distal part of the limb.

7. An orthosis according to claim 1, wherein each of the confronting surfaces of pair of proximal and distal shafts are contoured to conform to the profile of the adjacent parts of the limb to which the orthosis is to be fitted.

8. An orthosis according to claim 1, wherein the biasing means remains approximately in the plane of relative movement of the proximal and distal shafts to which it is joined during operation of the orthosis.

* * * * *